US006226474B1

(12) United States Patent
Kowalski et al.

(10) Patent No.: US 6,226,474 B1
(45) Date of Patent: May 1, 2001

(54) AIR IMPINGEMENT POST FUSER RECEIVER MEMBER COOLER DEVICE

(75) Inventors: Gregory Leo Kowalski, Victor; Tsutumu Miura, Pittsford; Curtis Lee Vernon, Rochester, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/464,423

(22) Filed: Dec. 16, 1999

(51) Int. Cl.[7] ..... G03G 21/20
(52) U.S. Cl. ..... 399/92; 399/320
(58) Field of Search ..... 399/92, 320, 328, 399/406; 430/97, 124; 432/59, 77; 34/62, 66, 89.1, 92; 271/194, 195; 347/155, 156

(56) References Cited

U.S. PATENT DOCUMENTS 4,959,693 * 9/1990 Mitsuya et al. ..... 399/328 X
5,086,209 * 2/1992 Kintz et al. ..... 399/92 X
5,153,656 * 10/1992 Johnson et al. ..... 430/124 X
5,557,388 * 9/1996 Creutzmann et al. ..... 399/92

FOREIGN PATENT DOCUMENTS 61-022375 * 1/1986 (JP) .

* cited by examiner

*Primary Examiner*—Sophia S. Chen
(74) *Attorney, Agent, or Firm*—Lawrence P. Kessler

(57) ABSTRACT

A device for cooling receiver members after image fixing by the fuser assembly in an electrographic reproduction apparatus wherein a marking particle image is fixed to a receiver member with application of heat by the fuser assembly, the receiver member traveling along a transport path. The cooling device includes an upper housing and a lower housing respectively associated with the receiver member transport path, on opposite sides thereof, immediately downstream, in the direction of receiver member travel along the transport path, of the fuser assembly. The upper and lower housings respectively have transport path guide plates for guiding receiver members along the transport path. A plurality of ports defined in the upper housing transport path guide plate provide flow communication of pressurized air from a pressurized air source to the transport path, and a plurality of ports in the lower housing transport path guide plate provide flow communication of pressurized air from the pressurized air source to the transport path. Accordingly, air impingement for forced air provides convection cooling of receiver members traveling along the transport path and such air impingement also provides for transport of the receiver members via an air bearing thereby substantially preventing the receiver members from contacting the upper and lower guide path plates.

19 Claims, 3 Drawing Sheets

AIR IMPINGEMENT POST FUSER RECEIVER MEMBER COOLER DEVICE

FIELD OF THE INVENTION

This invention relates in general to receiver member transport in electrographic reproduction apparatus, and more particularly to a cooler device in the receiver member transport path downstream of a fuser assembly of an electrographic reproduction apparatus.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly, utilized in typical reproduction apparatus, includes at least one heated roller and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

When a receiver member is fused, it picks up quite a considerable amount of heat. As the fused image bearing receiver member travels along the transport path it looses some of the stored heat, thus heating up other elements of the reproduction apparatus. This tends to adversely effect the reproduction apparatus elements making them less dependable. As a result, receiver member jams may occur more often. When the receiver member finally comes to rest in a suitable output tray, other fused image bearing receiver member usually follow to form an output stack. As a result, heat stored in the receiver members will increase the overall temperature of the receiver member stack. Tests have shown that if this temperature is higher than 140° F., the marking particles of one receiver member tends to sticks to the next receiver member, making several reproductions undesirably stick together to form a "brick". Accordingly, it has been the general practice to provide an extended travel path for fused image bearing receiver members, or a cooler device directly following the fuser (see for example U.S. Pat. No. 5,221,200, issued on Jun. 22, 1993, in the name of Roztocil et al). The extended transport path enables a receiver member reaching the stack to have somewhat cooled down as it travels along the transport path before reaching the stack. However, the extended transport path may undesirably increases the size of the reproduction apparatus. On the other hand, the prior art cooler devices have not always been efficient enough to yield the required receiver member temperature reduction for a reasonable size, power consumption, and noise generation.

SUMMARY OF THE INVENTION

In view of the above, this invention is directed to a device for cooling receiver members after image fixing by the fuser assembly in an electrographic reproduction apparatus wherein a marking particle image is fixed to a receiver member with application of heat by the fuser assembly, the receiver member traveling along a transport path. The cooling device includes an upper housing and a lower housing respectively associated with the receiver member transport path, on opposite sides thereof, immediately downstream, in the direction of receiver member travel along the transport path, of the fuser assembly. The upper and lower housings respectively have transport path guide plates for guiding receiver members along the transport path. A plurality of ports defined in the upper housing transport path guide plate provide flow communication of pressurized air from a pressurized air source to the transport path, and a plurality of ports defined in the lower housing transport path guide plate provide flow communication of pressurized air from the pressurized air source to the transport path. Accordingly, air impingement for forced air provides convection cooling of receiver members traveling along the transport path and such air impingement also provides for transport of the receiver members via an air bearing thereby substantially preventing the receiver members from contacting the upper and lower guide path plates.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
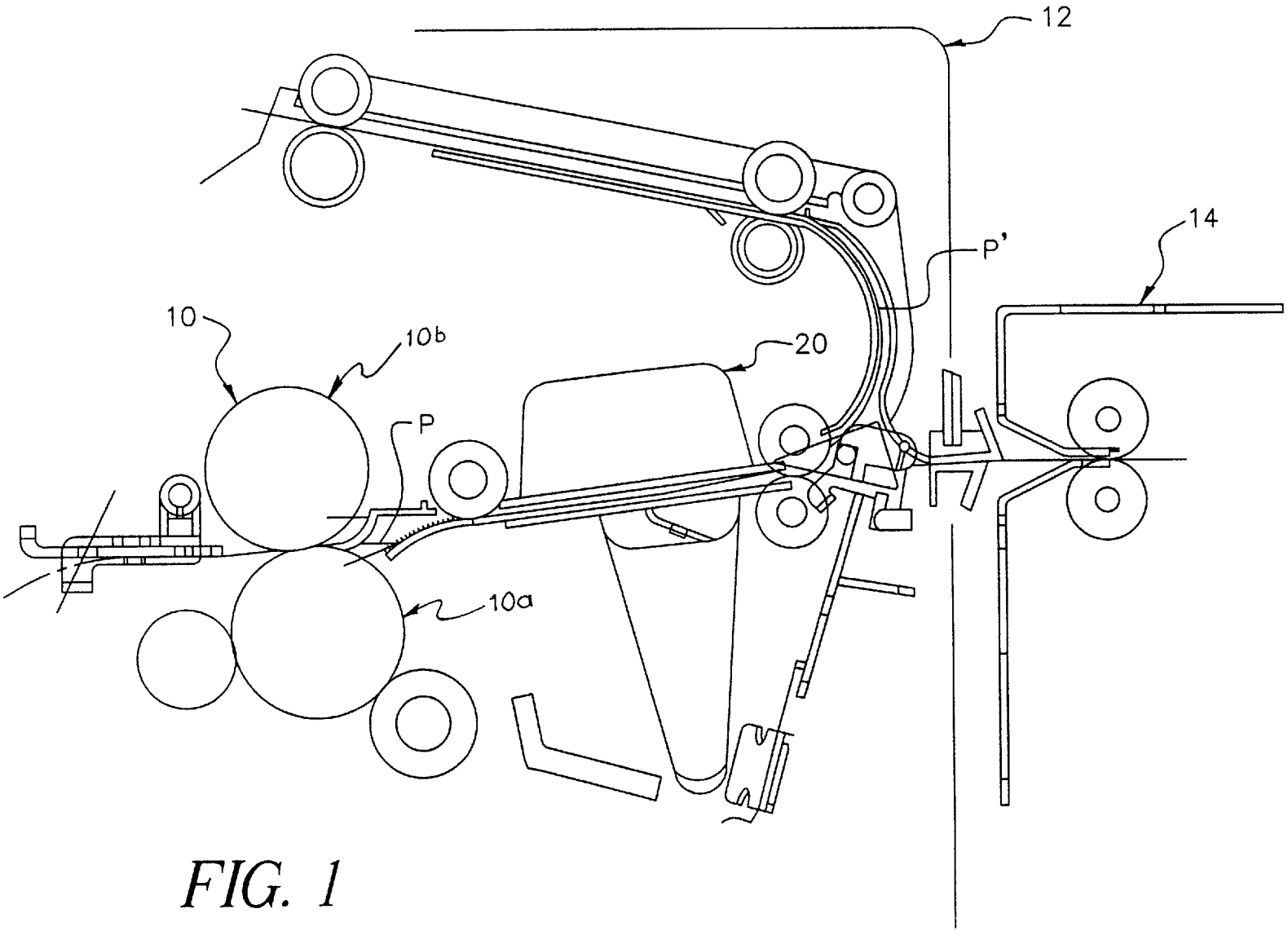
FIG. 1 is a side elevational view of the air impingement post fuser receiver member cooler device, according to this invention, shown in association with an electrographic reproduction apparatus fuser assembly and post fuser assembly transport path, with portions removed to facilitate viewing.

Referring now to the accompanying drawings, FIG. 1 shows an exemplary fuser assembly 10 for an electrographic reproduction apparatus 12. The exemplary fuser assembly 10 includes a heated fusing roller 10*a* in nip relation with a pressure roller 10*b*. The fusing nip between the rollers is associated with the transport path P of the reproduction apparatus 12. As such, marking particle images are fixed to a receiver member by application of heat and pressure in the fusing nip before the receiver member is delivered from the transport path P to an output device 14 or a recirculation path P'. Immediately downstream of the fuser assembly 10, in the direction of receiver member travel, is an air impingement cooler device, designated generally by the numeral 20, according to this invention. The air impingement cooler device 20 is more compact and efficient than coolers typically found in the electrographic reproduction apparatus of the prior art and is more reliable in transporting fused image-bearing receiver members.

Figure 2:
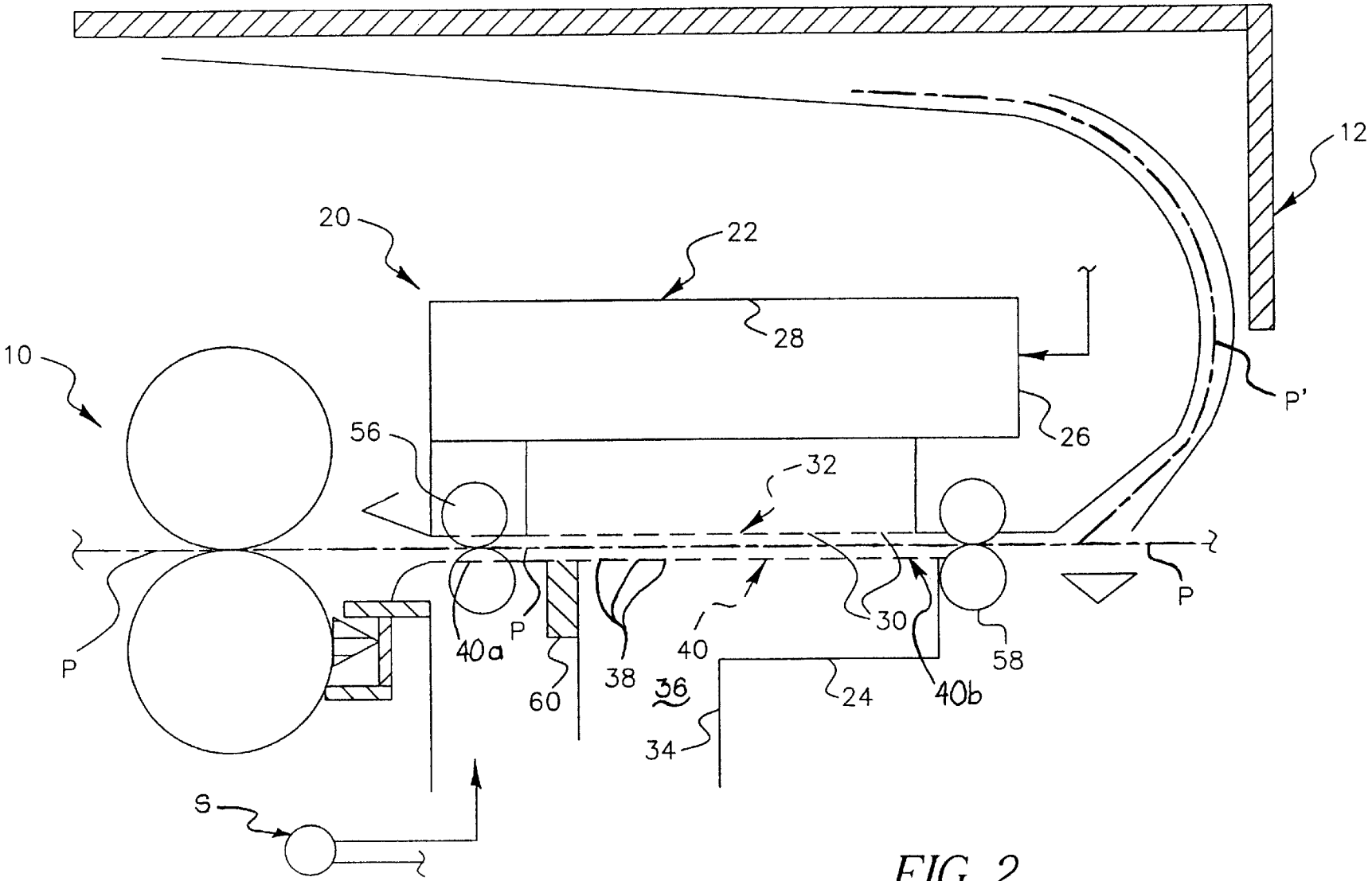
FIG. 2 is a schematic side elevational view of the air impingement post fuser receiver member cooler device as shown in FIG. 1.

The air impingement cooler device 20, as best shown in FIG. 2, includes an upper housing 22 and a lower housing 24 respectively associated with the receiver member transport path P, on opposite sides thereof, immediately downstream, in the direction of receiver member travel along the transport path, of the fuser assembly 10. The upper housing 22 defines a chamber formed of a heat conductive material, such as thin sheets of aluminum for example. An inlet opening 26 communicating with the chamber of the upper housing 22 is connected to a source of pressurized air S. The pressurized air source is for example a blower of the low pressure, high flow type (e.g., blower operating at 1000 to 2000 FPM exit nozzle velocity at 0.5 to 0.9 PSI static pressure).

The location of the inlet opening 26 to the chamber of the upper housing 22 is selected to form a high top air duct 28 for directing pressurized air through a plurality of ports 30 in an upper path guide plate 32. The ports 30 are configured as a large number of substantially round holes lying in a zigzag pattern in the direction of receiver member travel (see FIG. 3). The location (and number) of the holes is particularly selected to direct air flow substantially perpendicular to the receiver member transport path P so as to form an air bearing for receiver members as they travel seriatim along the transport path. By such arrangement, the need for a space consuming separate air manifold, and cooling fins, as found in the prior art, are eliminated.

The lower housing 24 defines a chamber also formed of a heat conductive material, such as thin sheets of aluminum for example. An inlet opening 34 communicating with the chamber of the lower housing 24 is connected to the source of pressurized air S (described above), or alternatively to an independent source of pressurized air, perhaps operating at a different pressure level and/or flow rate. The location of the inlet opening 34 is selected to form an air duct 36 for directing pressurized air through a plurality of ports 38 in a lower path guide plate 40. The ports 38 are configured as a number of slots 38*a* along with a plurality of holes 38*b* (see FIG. 4). The location (and number) of holes 38*b*, outboard of the slots 38*a* and the orientation of the slots, are particularly selected to direct air flow substantially toward the exit end of the upper and lower path guide plates (elements 32 and 40) of the receiver member transport path P so as to form an air bearing for receiver members as they travel seriatim along the transport path.

The lower path guide plate 40 may be formed as a two-piece structure. The main body 40*a* of the lower path guide plate 40 is for example a heat conductive material such as aluminum, and the lead edge 40*b* of the lower path guide plate is for example a heat insulating material such as plastic. By this arrangement, the susceptibility of the plate 40 to marking particle and paper dust contamination is substantially reduced. As such, the holes and slots are not likely to become clogged, and there is no build-up on the surfaces of the plate. This assures that the efficiency of the cooler device 20 remains at a high level by substantially preventing condensation problems and adverse build-up of temperature in the plate material during long reproduction runs.

The air impingement cooler device 20 also includes two pairs of receiver member transport rollers 56 and 58. The roller pair 56 at the entrance to the cooler device 20 serves as a cooler for receiver members entering the cooler device, while the roller pair 58 assures that receiver members are under a positive control as they are transported along the transport path P (or P') through the cooler device and then downstream thereof (that is, the receiver members are always under the control of at least one transport roller nip). A suitable insulator 60 is provided for the lower housing 24 of the air impingement cooler device. The insulator 60 is mounted to the housing 24 adjacent to the roller pair 56 for preventing heat from the fuser assembly 10 from heating up the lower housing 24.

As described, the air impingement cooler device 20 according to this invention provides for forced air convection cooling of receiver members traveling along the transport path P immediately subsequent to fixing of pigmented marking particle images thereto by an exemplary heat/pressure fuser assembly 10. The positive air pressure utilized by the cooler device accomplishes cooling efficiently by convection at a high air flow velocity. Moreover, efficiency is improved by providing a higher air flow at the transport path centerline, while decreasing the air flow out toward the marginal edges of the transport path. Such air flow characteristics provide for transport the receiver members via an air bearing thereby substantially prevent the receiver members from contacting the guide surfaces of the cooler device 20. This reduces contamination and improves heat transfer efficiency without building up temperature during long reproduction runs. Further, by using the air bearing approach to receiver member transport, there is no sliding friction during receiver member transport. Accordingly, contact artifacts in the marking particle images fixed on the receiver members are substantially prevented.

It has been determined that using an aluminum sheet metal air impingement cooler device of the type described according to this invention yields a lower temperature than prior art coolers because the aluminum sheet metal has less heat capacity than an aluminum extrusion cooler for example. Less heat capacity can bring a quick response of the temperature. In other words, a recovery of temperature by the pressurized air flow is easy to stabilize. Since the heat of the receiver member lower path guide 40 comes from the front part 40*b* of the guide by heat conduction, the two-piece lower path guide provides for isolation of the rear part 40*a* of this guide from the front part 40*b* of the guide with the insulator 60.

Figure 3:
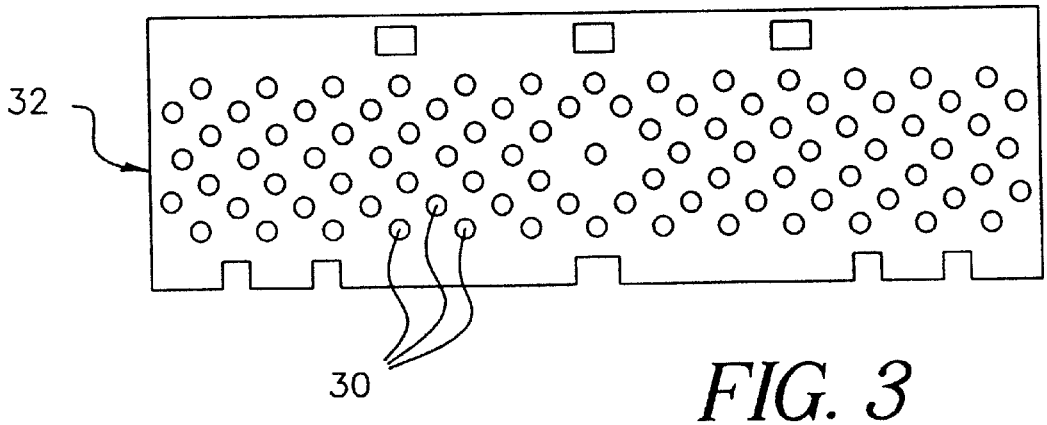
FIG. 3 is a bottom plan view of a preferred cooler surface hole pattern for the air impingement post fuser receiver member cooler device as shown in FIG. 1.
Figure 4:
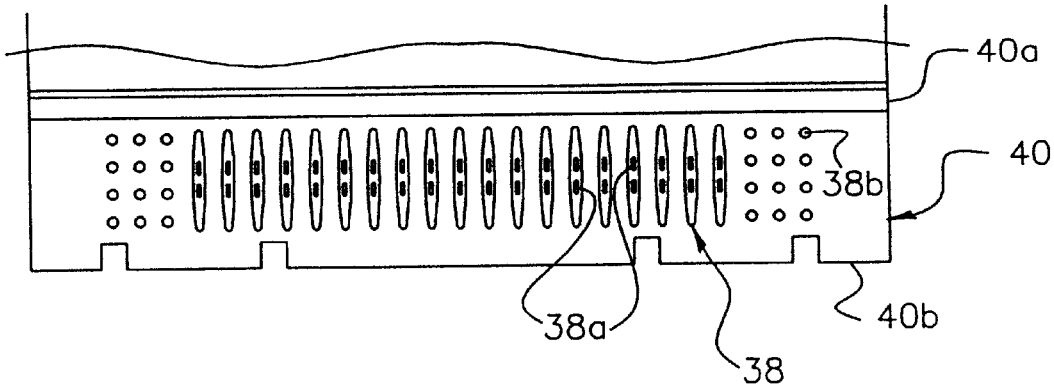
FIG. 4 is a top plan view of a preferred receiver member lower guide member hole pattern for the air impingement post fuser receiver member cooler device as shown in FIG. 1.

The hole patterns of the air impingement cooler device 20, according to this invention, and the receiver member lower path guide plate 40 are key factors determining the effective cooling parameter for this device. The preferred hole and slot patterns, as shown in FIGS. 3 and 4, were selected as the most effective combination, at static air pressures with independent blowers (for example set at +0.75 inch-$H_2O$ and +0.65 inch-$H_2O$ for the upper housing and lower housing respectively). Of course, the use of a single blower for both the upper and lower housing is suitable for use with this invention. It should be noted that if the holes were to be made larger, more air flow could be provided, but the fuser roller temperature would be adversely effected. The described air impingement concept of this invention has been shown to be effective across all receiver members (that is, the effectiveness of the concept does not vary by type or weight of the receiver members). Further, the degree of cooling for the receiver members has been shown to be sufficient to bring the receiver members to a final temperature, prior to stacking, such that stacked receiver members will not be subject to bricking.

The invention has been described in detail with particular reference to certain preferred embodiments thereof, but it will be understood that variations and modifications can be effected within the spirit and scope of the invention.

What is claimed is:

1. In an electrographic reproduction apparatus wherein a marking particle image is fixed to a receiver member with application of heat by a fuser assembly, said receiver member traveling along a transport path, a device for cooling receiver members after image fixing by said fuser assembly, said cooling device comprising:

an upper housing and a lower housing respectively associated with said receiver member transport path, on opposite sides thereof, immediately downstream, in the direction of receiver member travel along said transport path, of said fuser assembly, said upper and lower housings respectively having transport path guide plates extending from an entrance to an exit for guiding receiver members along said transport path;

at least one source of pressurized air; and a plurality of ports defined in said upper housing transport path guide plate providing flow communication of pressurized air from said pressurized air source to said transport path, and a plurality of ports defined in said lower housing transport path guide plate providing flow communication of pressurized air from said pressurized air source to said transport path, said ports in said lower housing transport path guide plate being configured as a number of slots and a plurality of holes outboard of said slots, the orientation of said slots being particularly selected to direct air flow substantially toward said exit of said upper and lower transport path guide plates where receiver members exit therefrom to provide an air bearing for receiver members as they travel seriatim along said transport path; whereby air impingement provides for forced air convection cooling of receiver members traveling along said transport path and such air impingement also provides for transport of said receiver members via an air bearing thereby substantially preventing said receiver members from contacting said upper and lower path guide plates.

2. The air impingement cooling device according to claim 1 wherein said plurality of ports defined in said upper housing transport path guide plate are configured as a large number of substantially round holes lying in a zigzag pattern in the direction of receiver member travel to provide positive air flow substantially perpendicular to said receiver member transport path.

3. The air impingement cooling device according to claim 1 wherein said lower transport path guide plate is formed as a two-piece structure including a main body formed of a heat conductive material, and a lead edge portion formed of a heat insulating material.

4. The air impingement cooling device according to claim 1 wherein said pressurized air source and said configuration of said holes and slots in said upper and lower transport path guide plates are selected to provide a higher air flow at a centerline of said transport path, while decreasing the air flow out toward marginal edges of said transport path.

5. The air impingement cooling device according to claim 4 wherein said pressurized air source includes a blower providing an air flow velocity of low pressure, high flow.

6. The air impingement cooling device according to claim 5 wherein said blower operates to provide air flow in a range of about 1000 to 2000 FPM exit nozzle velocity, in a range of about 0.5 to 0.9 PSI static pressure.

7. The air impingement cooling device according to claim 4 wherein said pressurized air source includes a pair of blowers, respectively communicating with said upper and lower housings, providing an air flow velocity of low pressure, high flow to each housing.

8. The air impingement cooling device according to claim 1 wherein said upper housing and lower housing further include two pairs of receiver member transport rollers.

9. The air impingement cooling device according to claim 8 wherein one of said two roller pairs is located adjacent to said entrance to said upper housing and lower housing and serves as a cooler roller, and the other of said two roller pairs is located adjacent to said exit from said upper housing and lower housing and assures that receiver members are securely transported along the transport path downstream of said upper housing and lower housing.

10. The air impingement cooling device according to claim 7 wherein an insulator is provided for substantially preventing heat from said fuser assembly from reaching said lower housing, said insulator being mounted to said lower housing adjacent to said one of said two roller pairs.

11. A fuser assembly for an electrographic reproduction apparatus wherein a marking particle image is fixed to a receiver member, traveling along a transport path, said fuser assembly comprising:

fusing members in relation with said receiver member transport path on opposite sides thereof, at least one of said fusing members being heated to a temperature sufficient to tack marking particles to a receiver member, and another of said fusing members applying pressure to said heated fusing member;

an upper housing and a lower housing respectively associated with said receiver member transport path, on opposite sides thereof, immediately downstream, in the direction of receiver member travel along said transport path, of said fuser assembly, said upper and lower housings respectively having transport path guide plates extending from an entrance to an exit for guiding receiver members along said transport path;

at least one source of pressurized air; and a plurality of ports defined in said upper housing transport path guide plate providing flow communication of pressurized air from said pressurized air source to said transport path, and a plurality of ports defined in said lower housing transport path guide plate providing flow communication of pressurized air from said pressurized air source to said transport path, said plurality of ports in said upper housing transport path guide plate being configured as a large number of substantially round holes lying in a zigzag pattern in the direction of receiver member travel to provide positive air flow substantially perpendicular to said receiver member transport path, and wherein said ports in said lower housing transport path guide plate being configured as a number of slots and a plurality of holes outboard of said slots, the orientation of said slots being particularly selected to direct air flow substantially toward the exit end of said upper and lower transport path guide plates to provide an air bearing for receiver members as they travel seriatim along said transport path; whereby air impingement provides for forced air convection cooling of receiver members traveling along said transport path and such air impingement also provides for transport of said receiver members via an air bearing thereby substantially preventing said receiver members from contacting said upper and lower transport path guide plates.

12. The fuser assembly according to claim 11 wherein said fusing members are a pair of rollers in nip relation with respect to said receiver member transport path.

13. The fuser assembly according to claim 12 wherein said upper housing and lower housing further include two pairs of receiver member transport rollers, one of said two roller pairs being located adjacent to said entrance to said upper housing and lower housing and serves as a cooler roller, and the other of said two roller pairs being located adjacent to said exit from said upper housing and lower housing and assures that receiver members are securely transported along the transport path downstream of said upper housing and lower housing.

14. The fuser assembly according to claim 13 wherein an insulator is provided for substantially preventing heat from said heated fusing member from reaching said lower housing, said insulator being mounted to said lower housing adjacent to said one of said two roller pairs.

15. The fuser assembly according to claim 13 wherein said pressurized air source and said configuration of said holes and slots in said upper and lower transport path guide plates are selected to provide a higher air flow at a centerline of said transport path, while decreasing air flow out toward marginal edges of said transport path.

16. The air impingement cooling device according to claim 15 wherein said pressurized air source includes a blower providing an air flow velocity of low pressure, high flow in a range of about 1000 to 2000 FPM exit nozzle velocity at in a range of about 0.5 to 0.9 PSI static pressure.

17. The air impingement cooling device according to claim 15 wherein said pressurized air source includes a pair of blowers, respectively communicating with said upper and lower housings, providing an air flow velocity of low pressure, high flow to each housing.

18. A method for cooling receiver members after image fixing by a fuser assembly for an electrographic reproduction apparatus wherein a marking particle image is fixed to a receiver member traveling along a transport path, with application of heat, said cooling method comprising the steps of:

directing a flow of pressurized air to said receiver member transport path for forced air impingement for convection cooling of receiver members traveling along said transport path and for transport of said receiver members via an air bearing, said pressurized air providing a higher air flow at a centerline of said transport path, while decreasing the air flow out toward marginal edges of said transport path.

19. The air impingement cooling method according to claim 18 wherein said pressurized air source provides an air flow velocity of low pressure, high flow.

* * * * *